US006977591B2

(12) United States Patent
Boyer et al.

(10) Patent No.: US 6,977,591 B2
(45) Date of Patent: Dec. 20, 2005

(54) SMART POWER CONTROL TECHNIQUE TO REDUCE POWER AND HEAT CONSUMPTION

(75) Inventors: Curtis Elroy Boyer, Milford, MI (US); Benjamin T. Sung, Farmington Hills, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 622 days.

(21) Appl. No.: 10/157,326

(22) Filed: May 29, 2002

(65) Prior Publication Data

US 2003/0038017 A1 Feb. 27, 2003

Related U.S. Application Data

(60) Provisional application No. 60/314,430, filed on Aug. 23, 2001.

(51) Int. Cl.[7] ..... G08B 21/00

(52) U.S. Cl. ..... 340/635; 340/640; 340/644; 340/655; 219/202; 219/208; 165/58; 237/28

(58) Field of Search ..... 340/635, 640, 340/581, 433, 438, 540, 644, 655, 660, 661; 73/119 A; 219/202, 208; 165/41, 42, 58; 237/28, 34

(56) References Cited

U.S. PATENT DOCUMENTS 5,386,185 A * 1/1995 Beck et al. ..... 318/762
6,164,367 A * 12/2000 Kurahashi et al. ..... 165/42
6,516,658 B1 * 2/2003 McCoy et al. ..... 73/119 A

* cited by examiner

*Primary Examiner*—Davetta W. Goins
(74) *Attorney, Agent, or Firm*—Brinks Hofer Gilson & Lione

(57) ABSTRACT

A method for monitoring a state of a switch is disclosed. The method includes providing a high side driver circuit in communication with a voltage source, activating the high side driver circuit at a first predefined time interval, and sourcing voltage to a resistor in communication with the high side driver circuit at the first predefined time interval. Further, the method monitors the switch at the first predefined time interval, and determines the state of the switch, and deactivates the high side drive at a second predefined time interval.

14 Claims, 3 Drawing Sheets

SMART POWER CONTROL TECHNIQUE TO REDUCE POWER AND HEAT CONSUMPTION

CROSS-REFERENCE TO RELATED APPLICATIONS

The present invention claims priority to U.S. Provisional Ser. No. 60/314,430 filed on Aug. 23, 2001 and entitled "Smart Power Control Technique To Reduce Power And Heat Consumption.

TECHNICAL FIELD

The present invention relates to electrical systems and methods for reducing power and heat consumption in electrical systems having a plurality of user actuatable switches for actuating various system functions and features.

BACKGROUND

Automotive convenience systems typically contain many switches and user actuatable regulators to modify system operation. For example, vehicle climate control systems include a variety of mechanical switches to operate various functions and features of the climate control system. It is not unusual to have more than ten selections or operating conditions or modes in a vehicle climate control system. A wetting current is typically applied to the switch to break the switch resistance. Conventionally, a resistor is selected to provide a limited amount of current necessary to break the switch resistance. Further, power is continuously applied to the switch and resistor in order to detect a change in state of the switch. One significant problem with this system is the heat and corresponding power consumption that occurs with this configuration.

Therefore, what is needed is a new and improved system and method for monitoring a state of a switch in an electrical system. The new and improved system and method should reduce energy and power consumption through the switch.

SUMMARY

The present invention utilizes a computer controlled power device to supply the necessary power to the resistor and switch set. Heat and energy consumption is reduced by applying power at predefined intervals to the resistor and switch to determine switch status. Thus, the present invention provides a system and method for reducing power consumption and heat dissipation. Advantageously, the performance of the system does not suffer any degradation.

In an aspect of the present invention a method for monitoring a state of a switch is provided. The method includes providing a high side driver circuit connected to a voltage source, activating the high side driver circuit at a first predefined time interval, sourcing voltage to a resistor in communication with the high side driver circuit at the first predefined time interval, monitoring the switch at the first predefined time interval, determining the state of the switch, and deactivating the high side drive at a second predefined time interval.

In another aspect of the present invention the method further includes selecting a resistor that provides a minimum wetting current to the switch.

In yet another aspect of the present invention a minimum wetting current of 124 milliamps is provided.

In still another aspect of the present invention activating the high side driver includes activating the high side driver at a first predefined time interval of 10 milliseconds.

In still another aspect of the present invention deactivating the high side driver further includes deactivating the high side driver at a second predefined interval of 90 milliseconds.

In yet another aspect of the present invention a processor in communication with the high side driver for activating and deactivating the high side driver which applies a control signal to the high side driver to activate and deactivate the high side driver at the first and second predefined time intervals respectively is provided.

These and other aspects and advantages of the present invention will become apparent upon reading the following detailed description of the invention in combination with the accompanying drawings.

DETAILED DESCRIPTION

Figure 1:
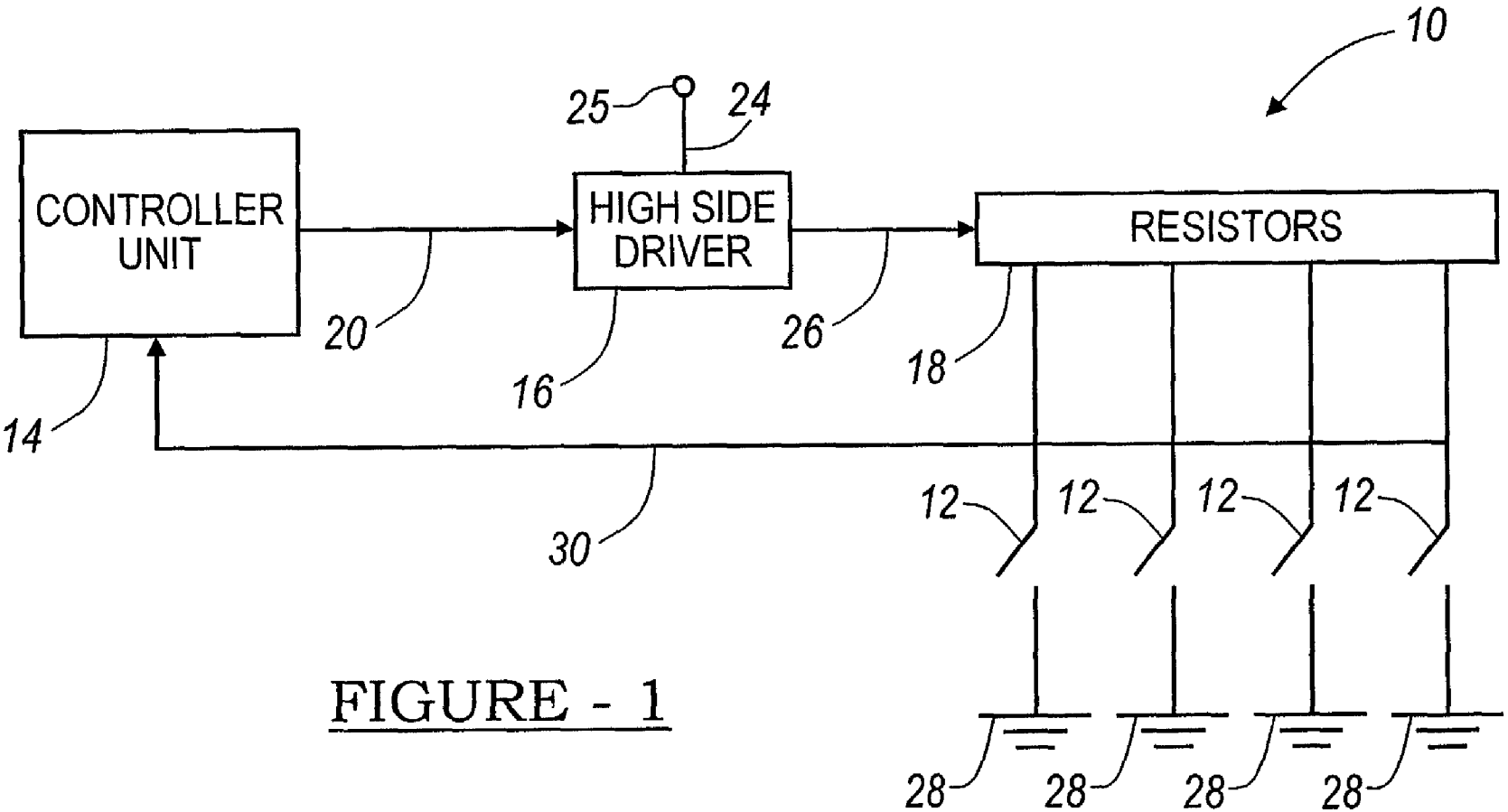
FIG. 1 is a schematic diagram illustrating a system for controlling the power consumption through a resistor switch set, in accordance with the present invention.

Referring now to FIG. 1, a system 10 for controlling the power consumption through a set of switches 12 is illustrated, in accordance with the present invention. System 10 includes a controller 14, a driver circuit 16 and a resistor set 18. Control unit 14 is in communication with driver circuit 16 via a control line 20. Driver circuit 16 receives power from a power source 22 via power line 24. Driver circuit 16 transmits a controlled amount of power along a controlled power line 26 to resistor set 18. Although resistor set 18 are shown as a plurality of resistors of course, a system comprising one resistor set is contemplated by the present invention. Resistor set 18 is connected to a plurality of switches 12 for providing a wetting current thereto. Switches 12, as stated, are connected to resistor set 18 on their high side and on their low side to grounding points 28. A switch status line 30 is connected to the high side of switches 12 and to controller 14. Switch status line 30, as will be described in further detail below, is used to determine when the switches are opened and when the switches are closed.

Figure 2:
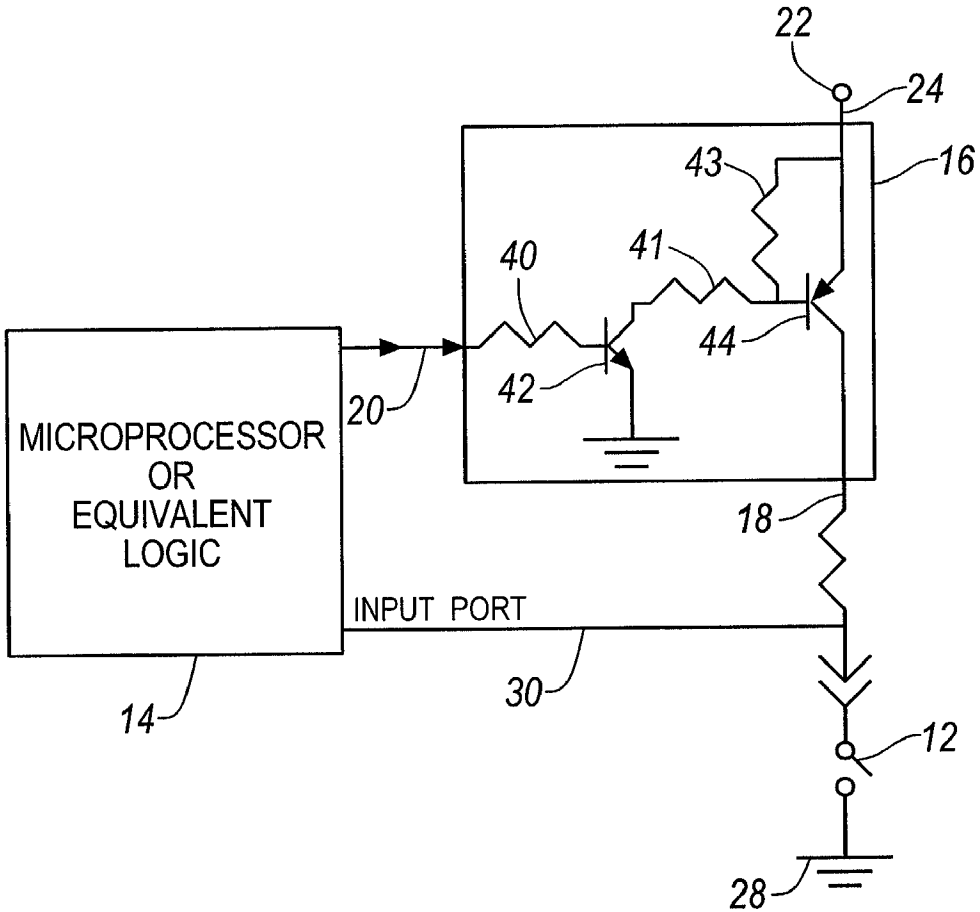
FIG. 2 is a circuit schematic diagram of the control system including a high side driver for providing a wetting current to a typical switch, in accordance with the present invention.

FIG. 2 is a more detailed schematic diagram of system 10, in accordance with the present invention. A typical driver circuit 16 includes a plurality of current limiting resistors, and actuator transistor 42 and a power switching resistor 44. In operation, control unit 14 provides a square wave actuation voltage or control signal via output line 20 to driver circuit 16. The control circuit is regulated by resistor 40 such that the actuator transistor 42 is turned on when the control signal is at a high level and turned off when the control signal is at a low signal. When actuator transistor 42 is turned on, current flows through resistors 43 and 41. Resistors 41 and 43 control the actuation of power switching transistor 44. Thus, when actuator resistor 42 is switched on, power switching transistor 44 is actuated and allows current to flow from power from power source 22 to resistor set 18. Resistor set 18 provides a limited amount of wetting current to switch 12. Switch status line 30 provides a switch status (switch closed or switch opened) when resistor set 18 provides the wetting current to switch 12.

Figure 3:
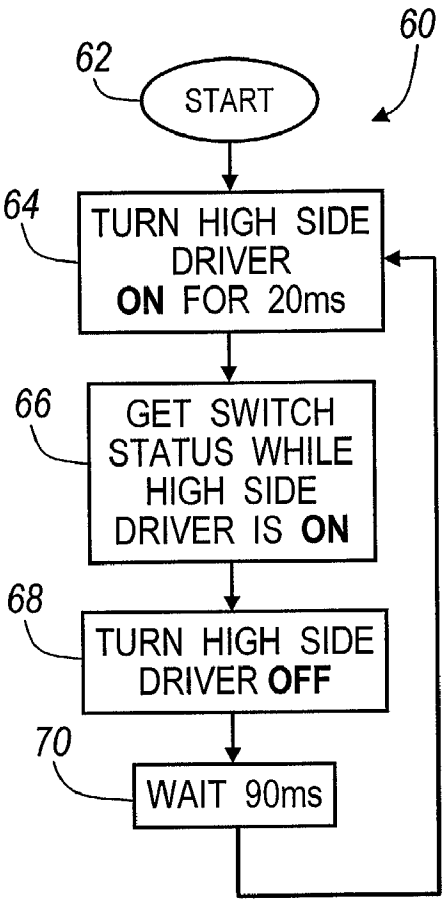
FIG. 3 is a flow chart illustrating a method for monitoring a state of a switch to reduce power consumption and heat dissipation, in accordance with the present invention.

FIG. 3 is a flow chart illustrating a method 60 for controlling the power consumption in system 10. The method is initiated at block 62 by a microprocessor or equivalent control logic. A high side driver is actuated or turned on for 20 milliseconds or for a predefined activation time as deemed appropriate, as represented by block 64. At block 66, the status of the switch or switches is determined during the 20 milliseconds (or predefined activation time) that the high side driver is turned on. In other words, a microprocessor or control logic determines whether the switch is opened or closed during the time the high side driver is on. The driver circuit is then turned off after the predefined activation time (such as 20 milliseconds) has expired, as represented by block 68. At block 70, a 90 millisecond delay or weight time is provided before the driver circuit is again activated. Thus, the method of the present invention provides a reduced power consumption and heat dissipation across resistors 18 as compared to prior art methods and systems.

Figure 4:
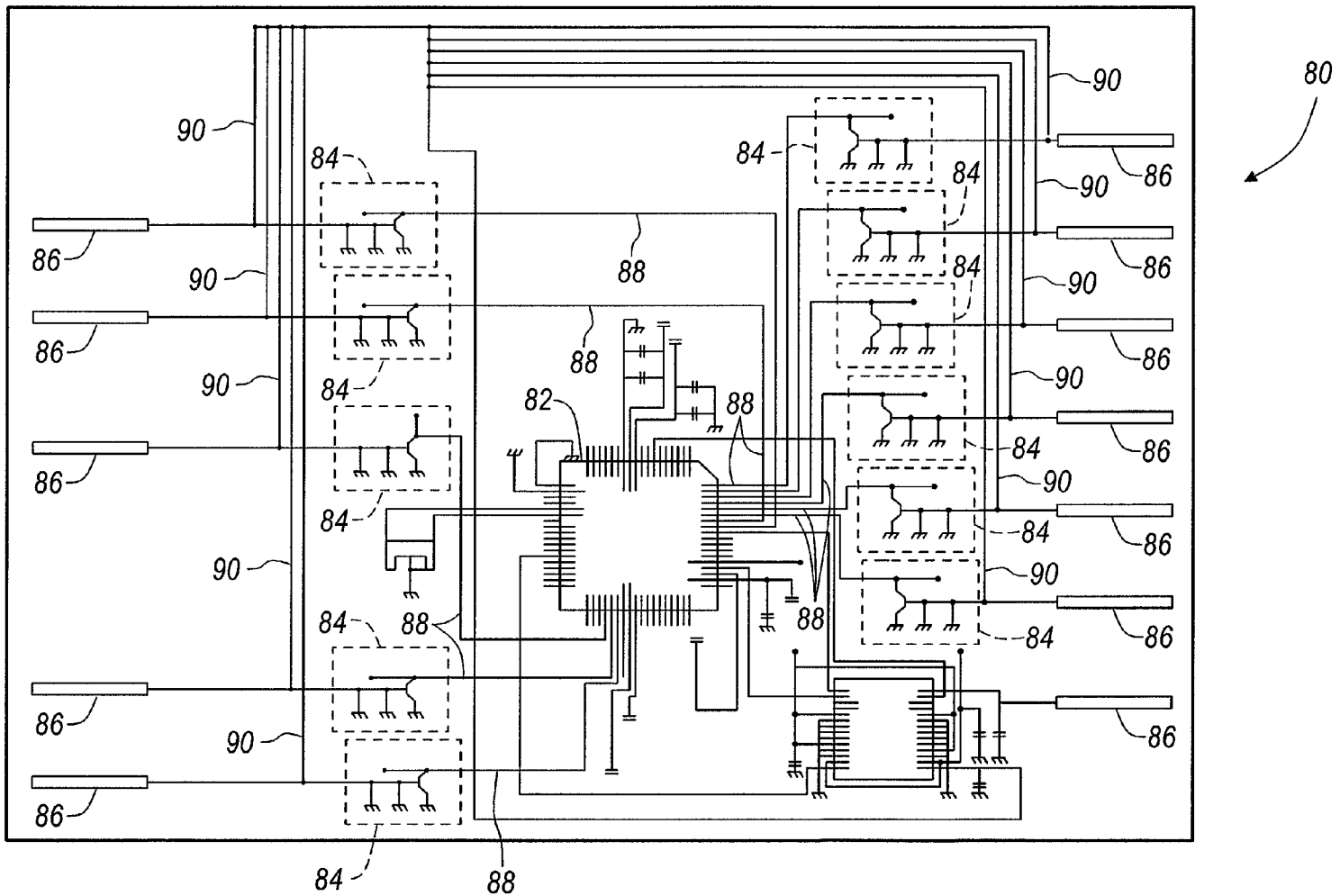
FIG. 4 is a more detailed electrical circuit diagram of a system for monitoring a plurality of switches in a vehicle climate control system for reducing power consumption in the system, in accordance with the present invention.

Referring now to FIG. 4, a preferred embodiment of an automobile air conditioning system 80 is illustrated, in accordance with the present invention. System 80 includes a microprocessor 82, a high side driver and wetting resistor circuits 84 and a plurality of air conditioning system control switches 86. Microprocessor 82 is any suitable processor such as the MC68HC11 offered by Siemen's Corporation of Germany. High side driver and resistor circuits 84 are circuits similar to those described previously and include the appropriate switching transistors and current limiting resistors for providing a wetting current to switches 86. In operation, driver and resistor circuits 84 receive a control signal such as the square wave control signal described previously via a control line 88 connected to microprocessor 82. A plurality of switch sense lines 90 are connected to the high side of switches 86 and to microprocessor 82 for determining the switch status (closed or opened) of switches 86. Typical automotive air conditioning switches include system on/off, AC on/off, blower on/off, evaporator temperature control, automatic mode on/off, etc.

System 80 would be controlled by the method described in FIG. 3, wherein the driver/resistor circuits 84 receive a control signal for microprocessor 82 and thereby provide a wetting current to the various switches 86. While the driver/resistor circuits are receiving power, the switch senses lines 90 determine the status of the plurality of switches 86. The driver/resistor circuits 84 then turned off and a delayed time is started for a predefined amount of time. After the predefined amount of time, the processor repeats itself whereby the driver/resistor circuits again provide a wetting current to switches 86.

Thus, the present invention has many advantages and benefits over the prior art. For example, the present invention reduces power consumption through the driver resistor circuits 84. Further, heat dissipation through various resistors is reduced. Additionally, the performance of the system such as the automotive air conditioning system described above, does not suffer any degradation.

As any person skilled in the art of electronic control systems will recognize from the previous detailed description and from the figures and claims, modifications and changes can be made to the preferred embodiments of the invention without departing from the scope of this invention defined in the following claims.

What is claimed is:

1. A method for monitoring a state of a switch, the method comprising:

(a) providing a high side driver circuit in communication with a voltage source;

(b) activating the high side driver circuit at a first predefined time interval;

(c) sourcing current to a resistor in communication with the high side driver circuit at the first predefined time interval;

(d) monitoring the switch at the first predefined time interval;

(e) determining the state of the switch; and (f) deactivating the high side drive at a second predefined time interval.

2. The method of claim 1 further comprises selecting a resistor that provides minimum wetting current for the switch.

3. The method of claim 2 wherein the minimum wetting current is 124 milliamps.

4. The method of claim 1 wherein activating the high side driver further comprises activating the high side driver at a first predefined time interval of 10 milliseconds.

5. The method of claim 1 wherein deactivating the high side driver further comprises deactivating the high side driver at a second predefined time interval of 90 milliseconds.

6. The method of claim 1 further comprising providing a processor in communication with the high side driver for activating and deactivating the high side driver.

7. The method of claim 1 further comprising applying a control signal to the high side driver to activate and deactivate the high side driver at the first and second predefined time intervals respectively.

8. A system for monitoring a state of a switch, the system comprising:

a high side driver circuit in communication with a voltage source, wherein the high side driver circuit is activated at a first predefined time interval;

a resistor in communication with the high side driver circuit, wherein the resistor receives the sourced voltage at the first predefined time interval;

wherein the switch is monitored at the first predefined time interval, to determine the state of the switch, and wherein the high side drive is deactivated at a second predefined time interval.

9. The system of claim 8 wherein the resistor is selected to provide a minimum wetting current for the switch.

10. The system of claim 9 wherein the minimum wetting current is 124 milliamps.

11. The system of claim 8 wherein the first predefined time interval is 10 milliseconds.

12. The system of claim 8 wherein the second predefined interval is 90 milliseconds.

13. The system of claim 8 further comprising a processor in communication with the high side driver for activating and deactivating the high side driver.

14. A monitoring system for determining a state of a switch in an automobile, wherein the switch controls an operation of a system in the automobile, the monitoring system comprising:

a high side driver circuit in communication with a voltage source, wherein the high side driver circuit is activated at a first predefined time interval;

a resistor in communication with the high side driver circuit, wherein the resistor receives the sourced voltage at the first predefined time interval and wherein the switch is monitored at the first predefined time interval, to determine the state of the switch, and wherein the high side drive is deactivated at a second predefined time interval.

* * * * *